US006802263B1

(12) United States Patent
Kolb

(10) Patent No.: US 6,802,263 B1
(45) Date of Patent: Oct. 12, 2004

(54) TABLE AND TRASH DISPOSAL COMBINATION DEVICE

(76) Inventor: George R. Kolb, 6125 Ducketts La., Elkridge, MD (US) 21075

( * ) Notice: Subject to any disclaimer, the term of this patent is extended or adjusted under 35 U.S.C. 154(b) by 16 days.

(21) Appl. No.: 10/328,040

(22) Filed: Dec. 26, 2002

(51) Int. Cl.[7] ..... A47B 65/00
(52) U.S. Cl. ..... 108/26
(58) Field of Search ..... 108/25, 26, 24, 108/50.18, 50.11, 20, 21, 22; 206/216; 220/910, 911

(56) References Cited

U.S. PATENT DOCUMENTS 1,579,823 A * 4/1926 Langguth ..... 108/26
2,474,101 A * 6/1949 Frothingham et al. ..... 232/1 R
2,508,802 A * 5/1950 Stanley ..... 108/28
2,683,639 A * 7/1954 Brenny ..... 108/26
4,428,305 A 1/1984 Creske
4,747,352 A * 5/1988 Guidry et al. ..... 108/26
5,055,081 A * 10/1991 Nayak ..... 108/26
5,353,716 A 10/1994 Wilbert
5,479,867 A * 1/1996 Blevins et al. ..... 108/94
5,542,359 A * 8/1996 Polries ..... 108/26
5,572,934 A * 11/1996 Aldridge et al. ..... 108/25
5,592,884 A * 1/1997 Glick et al. ..... 108/25
6,152,047 A 11/2000 Mac Namara
6,321,662 B1 * 11/2001 Fraise ..... 108/25

* cited by examiner

*Primary Examiner*—Jose V. Chen

(57) ABSTRACT

A table and trash disposal combination device includes a table including a tabletop having a top surface, a bottom surface and a peripheral edge. The tabletop has an opening extending therethrough. A plurality of legs is attached to and extends downward from the tabletop. A cover is positionable in the opening for substantially closing the opening. A garbage receptacle may be positioned below the table and aligned with the opening such that debris may be placed into the receptacle through the opening.

1 Claim, 3 Drawing Sheets

TABLE AND TRASH DISPOSAL COMBINATION DEVICE

BACKGROUND OF THE INVENTION

1. Field of the Invention

The present invention relates to table combinations and more particularly pertains to a new table combination for a table that would allow easy discarding of food and containers from an eating area.

2. Description of the Prior Art

The use of table combinations is known in the prior art. U.S. Pat. No. 4,428,305 describes a table lop having the major part of its surface rounding a central opening. Another type of table combination is U.S. Pat. No. 6,152,047 describes a table mounted trash disposal system including a container attached to a table. U.S. Pat. No. 5,353,716 describes a standing table with a hollow formed pedestal and table top for facilitating stacking of multiple tables together to save space.

While these devices fulfill their respective, particular objectives and requirements, the need remains for a device that facilitates easy convenient cleanup, serving of food, and the playing of games.

SUMMARY OF THE INVENTION

The present invention meets the needs presented above by incorporating an opening in the table top that empties into a garbage container. In addition the opening has a cover that can be used to cover the opening and is rotatable such that it can be utilized as a serving piece.

Another object of the present invention is to provide a new table combination that would save the user time and effort involved in cleanup.

Still another object of the present invention is to provide a new table combination that would be well suited for entertaining as users could easily dispose of unwanted items themselves with out leaving the table.

Yet another object of the present invention is to provide a cover for the opening that rotates such that game boards or food serving stations could be positioned on the cover and selectively rotated.

To this end, the present invention generally comprises a table including a tabletop having a top surface, a bottom surface and a. peripheral edge. The tabletop has an opening extending therethrough. A plurality of legs is attached to and extends downward from the tabletop. A cover is positionable in the opening for substantially closing the opening. A garbage receptacle may be positioned below the table and aligned with the opening such that debris may be placed into the receptacle through the opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
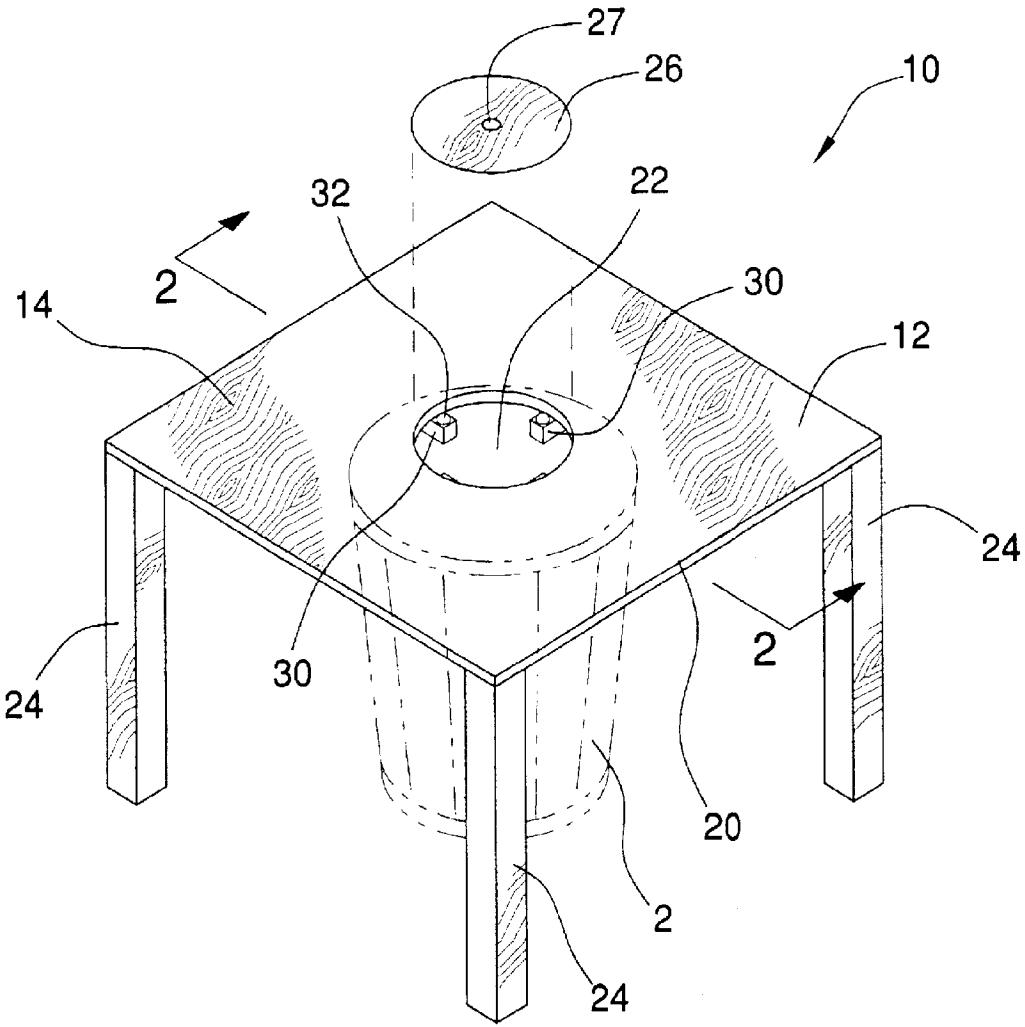
FIG. 1 is a perspective view of a table and trash disposal combination device according to the present invention.
Figure 2:
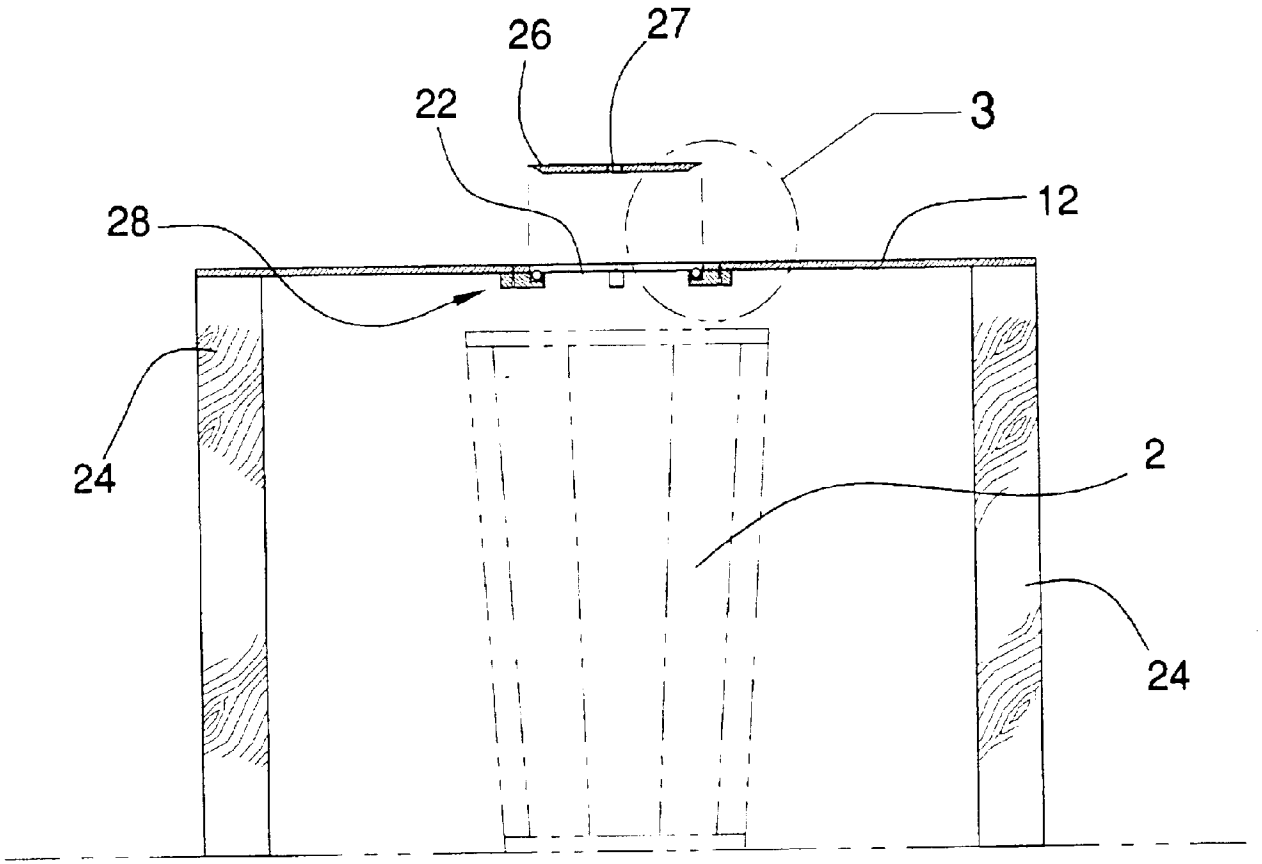
FIG. 2 is a cross-sectional view taken along the line 2—2 of FIG. 1 of the present invention.
Figure 3:
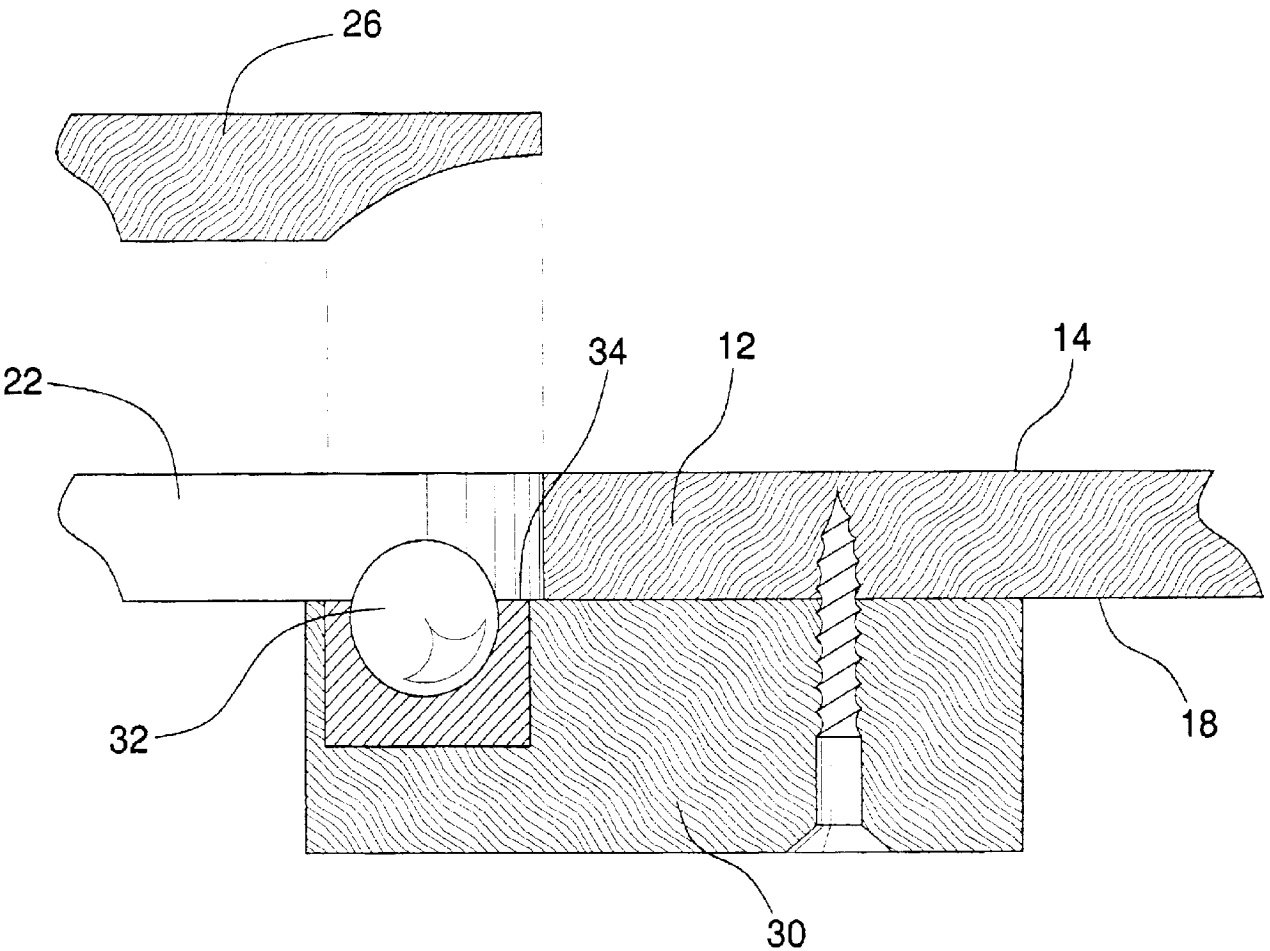
FIG. 3 is a cross-sectional view of the tabletop and arm of the present invention.

With reference now to the drawings, and in particular to FIGS. 1 through 3 thereof, a new table combination embodying the principles and concepts of the present invention and generally designated by the reference numeral 10 will be described.

As best illustrated in FIGS. 1 through 3, the table and trash disposal combination device 10 generally comprises a table 12 including a tabletop 14 having a top surface 16, a bottom surface 18 and a peripheral edge 20. The tabletop 14 has an opening 22 extending therethrough. The opening 22 is preferably substantially centrally disposed in the tabletop 14. A plurality of legs 24 is attached to and extends downward from the tabletop 14.

A cover 26 is positionable in the opening 22 for substantially closing the opening 22. A support assembly 28 is attached to the tabletop 14 for supporting the cover 26 in the opening 22. The support assembly 28 includes a plurality of arms 30. Each of the arms 30 is attached to the bottom surface 18 adjacent to the opening 22 and each extends inward such that when the cover 26 is positioned in the opening 22, it is positioned on the arms 30. Each of a plurality of ball bearings 32 is rotatably mounted on an upper surface 34 of one of the arms 30. The cover 26 rests on the ball bearings 32 when positioned in the opening 22. The cover 26 may be rotated on the bearings 32 to define a server. The cover 26 preferably has an aperture 27 extending therethrough for selectively receiving an umbrella, not shown.

In use, a garbage receptacle 2 may be positioned below the table 12 and aligned with the opening 22. When needed the, cover 26 may be removed such that debris may be placed in the receptacle 2 through the opening 22. When the cover 26 is on the support assembly 28, a food tray may be positioned on the cover 26 and rotated to act as a server. Alternatively, a game board may be positioned on the cover so that game players may rotate the game board for easier access thereto.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A table and trash disposal combination system comprising:

a table including a tabletop having a top surface, a bottom surface and a peripheral edge, said tabletop having a opening extending therethrough, said opening being substantially centrally disposed, a plurality of legs being attached to and extending downward from said tabletop;

a cover being positionable in said opening for substantially closing said opening, a support assembly being attached to said tabletop for supporting said cover in said opening, said support assembly including;

a plurality of arms, each of said arms being attached to said bottom surface adjacent to said opening and extending inward such that said cover is positioned on said arms when said cover is positioned in said opening;

a plurality of ball bearings, each of said ball bearings being rotatably mounted on an upper surface of one of said arms, said cover resting on said ball bearings when positioned in said opening, wherein said cover may be rotated on said bearings; and wherein a garbage receptacle may be positioned below said table and aligned with said opening such that debris may be placed into the receptacle through said opening.

* * * * *